US006805638B2

(12) United States Patent
Chang

(10) Patent No.: US 6,805,638 B2
(45) Date of Patent: Oct. 19, 2004

(54) ADJUSTABLE GOLF PUTTING PRACTICE DEVICE

(76) Inventor: Chen Te Chang, No. 78-1,, Shuyi 5th Lane, Nan Chiu, Taichung (TW), 402

( * ) Notice: Subject to any disclaimer, the term of this patent is extended or adjusted under 35 U.S.C. 154(b) by 0 days.

(21) Appl. No.: 10/339,084

(22) Filed: Jan. 10, 2003

(65) Prior Publication Data

US 2004/0137995 A1 Jul. 15, 2004

(51) Int. Cl.[7] ..... A63B 69/36
(52) U.S. Cl. ..... 473/160; 473/166
(58) Field of Search ..... 473/157–166, 473/181

(56) References Cited

U.S. PATENT DOCUMENTS 3,508,756 A * 4/1970 Bedford ..... 473/160
3,522,947 A * 8/1970 Anderson et al. ..... 473/158
4,222,568 A * 9/1980 Russo ..... 473/160
4,240,637 A * 12/1980 Cross et al. ..... 473/160
5,042,813 A * 8/1991 Huang ..... 473/153
5,855,522 A * 1/1999 Bevan ..... 473/160
6,146,284 A * 11/2000 Russell ..... 473/160

* cited by examiner

*Primary Examiner*—Mark S. Graham
(74) *Attorney, Agent, or Firm*—Rosenberg, Klein & Lee

(57) ABSTRACT

An adjustable golf putting practice device that a user can mechanically adjust the height and gradient near the golf hole without using power. The adjustable golf practice device has a base with a ball return gutter therein. Plural springs installed in the base. At least one ramp plate supported by the springs, the ramp plate has a hole therein corresponding to the ball return gutter. Plural means are used for positioning the ramp plate in desired height and slope and plural means are used for releasing the means for positioning the ramp plate. Thereby a user can adjust the height and gradient of the ramp plate near the golf hole simply by pushing the ramp plate and the push button of the means for ramp plate releasing means.

6 Claims, 14 Drawing Sheets

ADJUSTABLE GOLF PUTTING PRACTICE DEVICE

TECHNICAL FIELD

This invention relates generally to an adjustable golf putting practice device for providing a golf putting practice device that a user can adjust the height and gradient near the golf hole. More particularly, the present invention relates to a golf putting practice device that a user can mechanically adjust the height and gradient near the golf hole without using power.

BACKGROUND OF THE INVENTION

Golf is a popular game, widely enjoyed throughout the world. While the basics of golf are easy to learn, the subtle skills of driving and putting may take years to develop. Generally speaking, the key factor deciding the performance of putting depends on the judgment on the ramp gradient. A real golf course putting green has different gradients from golf hole to different directions. A player has to judge the gradient of the ramp according to the positions of the hole to the golf ball in order to decide the magnitude of the force he/she should apply to the golf ball. Therefore, it needs frequent practices to be skilled in putting. Although public and private golf courses are available in most cities, availability of an outdoor course will be dependent on weather conditions and the season. Furthermore, it is often impractical for a player to journey to a distant golf course for only a short practice round. To provide practice time off the course, a number of putting practice devices have been marketed.

Commercially available golf putting practice devices are known in the art with reference to FIG. 14, including those that simulate a golf putting green by using a closely cropped simulated grass indoor/outdoor carpeting material 53. These devices frequently have a ramped surface 51 which leads up to a flat putting platform 50 containing a golf putting cup 52 within a base 5. The ramp gradient of the traditional golf putting practice device is so large that cannot simulate a real golf putting green well. In addition, the traditional golf practice devices can only provide a fixed ramp gradient for practicers.

Another available putting practice device can let users to change the gradient and the height of the flat putting platform by a system including motor, hydraulic system, and power system. The system is very complicated and expensive. Besides, a user cannot precisely adjust the device since it's not easy to control the movement of an electrically powered system. Therefore a golf putting practice device that can precisely stimulate the ramp gradient of a real golf putting green by a mechanic device, which is easy to handle and inexpensive is needed and has been long desired

SUMMARY OF INVENTION

It is therefore an objective of the present invention to provide a golf putting practice device of mechanic structure for precisely stimulating putting green gradients.

The present invention, briefly summarized, in one embodiment discloses an adjustable golf putting practice device. The adjustable golf practice device has a base with a ball return gutter therein. Plural springs installed in the base. At least one ramp plate is supported by the springs. The ramp plate has a hole therein corresponding to the ball return gutter. Plural means are used for positioning the ramp plate in desired height and slope and plural another means are used for releasing the means for positioning the ramp plate. The means for positioning the plate includes a seat having a channel therein and two protrusions on two sides. An engaging element has a through hole therein and the engaging element is engaged with the ramp plate. A column comprises plural inward saw teeth therein and a head on the top. The column is inserted through the through hole and the head is bigger than the through hole, so the column will not slide out of the engaging element. In one embodiment of the invention, the means for releasing the means for positioning the ramp plate contains: a beam having a connecting hole in the middle. Two inserting elements are at both ends of the beam for inserting into the engaging holes of the fixing element. A push button is engaged with the connecting hole and two guiding rods are installed on the beam between the inserting elements. Plural hollow rods are installed on the base, wherein the guiding rods slide within the hollow rods respectively. In another embodiment of the invention, the means for releasing the means for positioning the ramp plate contains a push button and an inserting element connected to the push button for being engaged with the engaging hole.

BRIEF DESCRIPTION OF DRAWINGS

The invention will be more clearly understood after refer to the following detailed description read in conjunction with the drawings wherein.

DETAILED DESCRIPTION OF PREFERRED EMBODIMENTS

Figure 1:
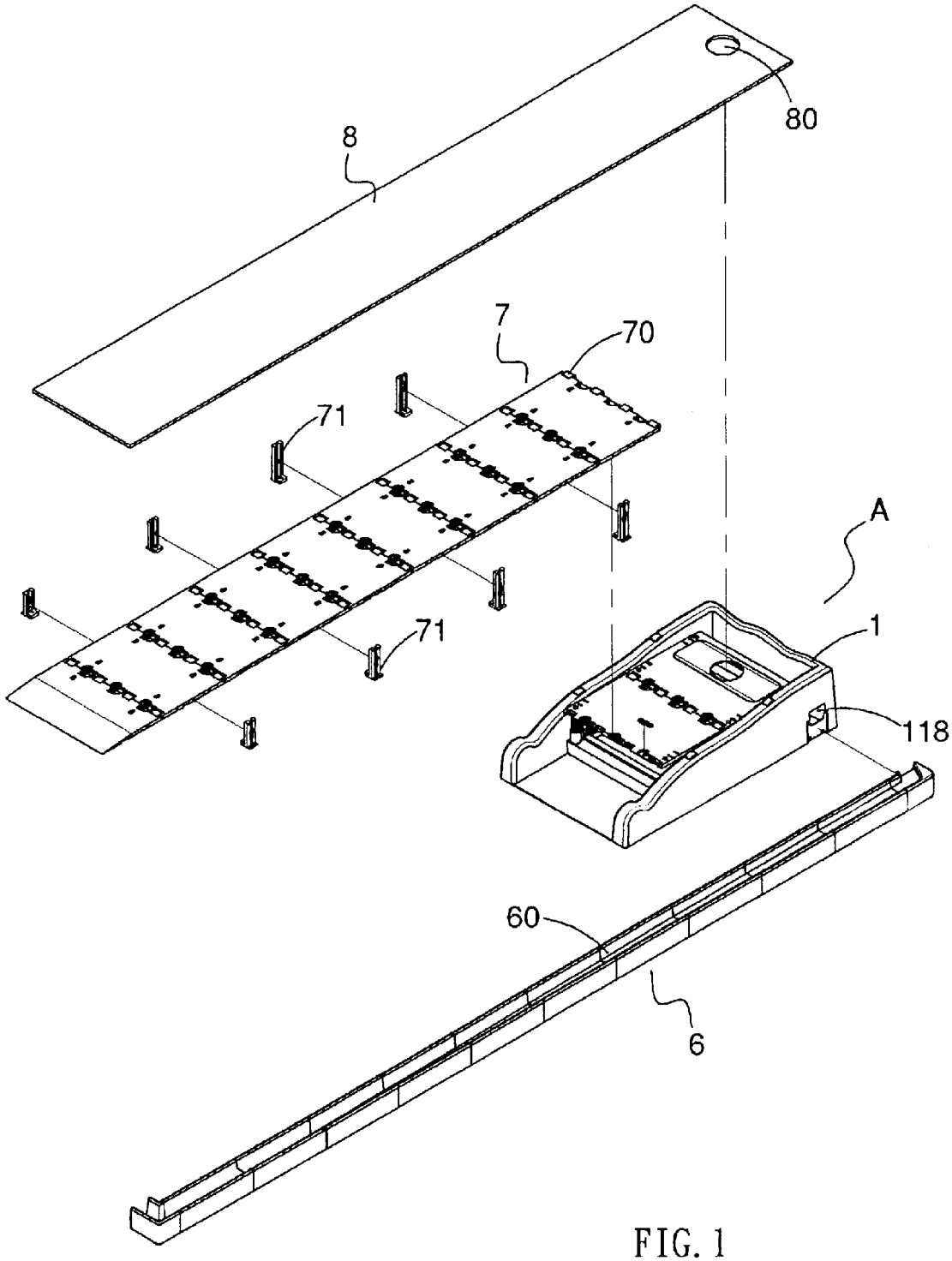
FIG. 1 is an application of an embodiment.

With reference to FIG. 1, letter A refers generally to an adjustable golf putting practice device. In the application, the adjustable golf practice device A is connected with a series of ramp plates 7, which is supported by plural height adjusting device 71. The artificial grass carpet 8 is applied on the ramp plates 7 and the adjustable golf putting practice device A. The ball return gutter 6 with the channel 60 for bringing golf balls to the player is connected to the adjustable golf putting practice device A with the ball exit hole 118.

Figure 2:
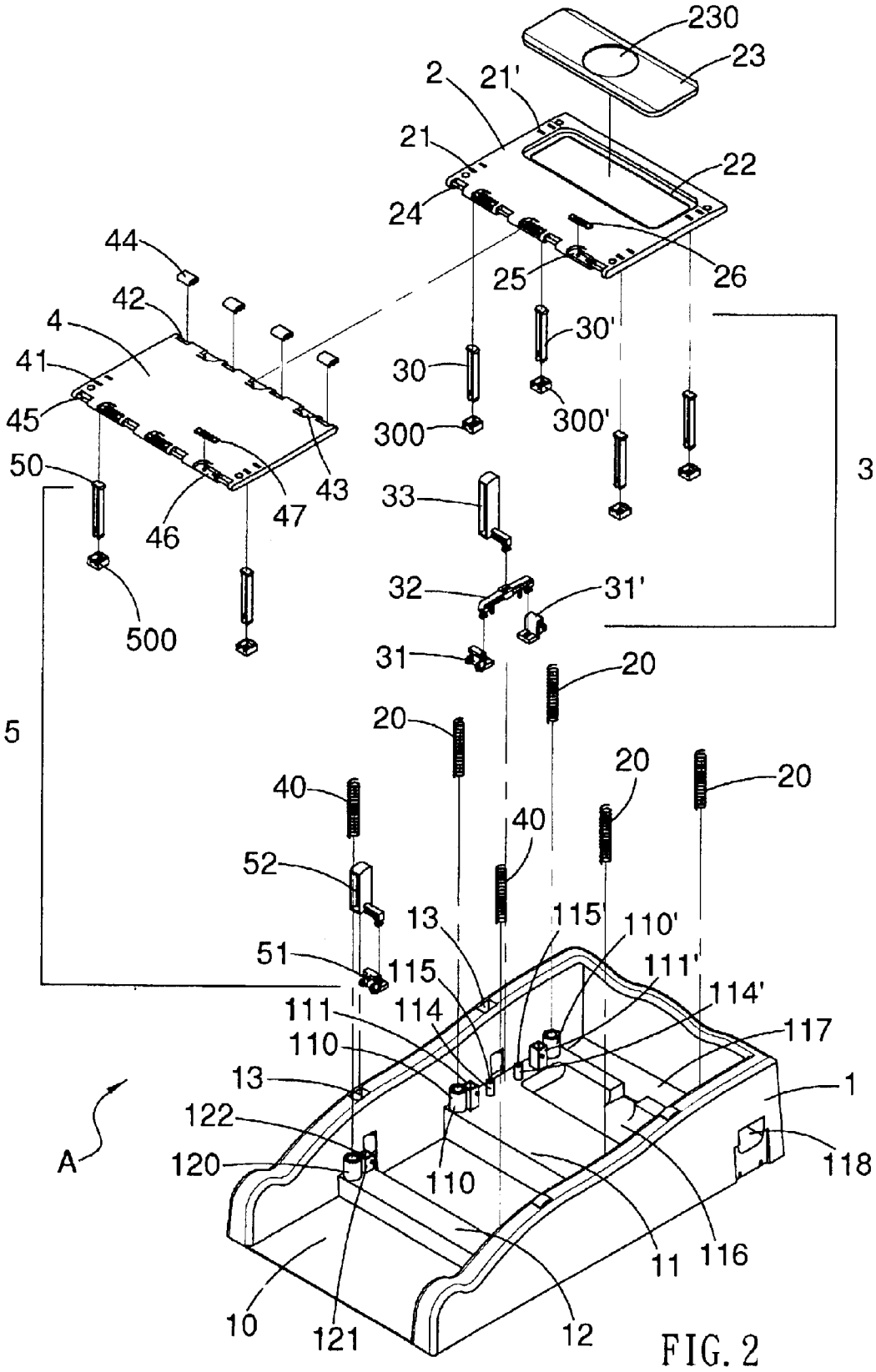
FIG. 2 is an exploded perspective view of the embodiment.
Figure 3:
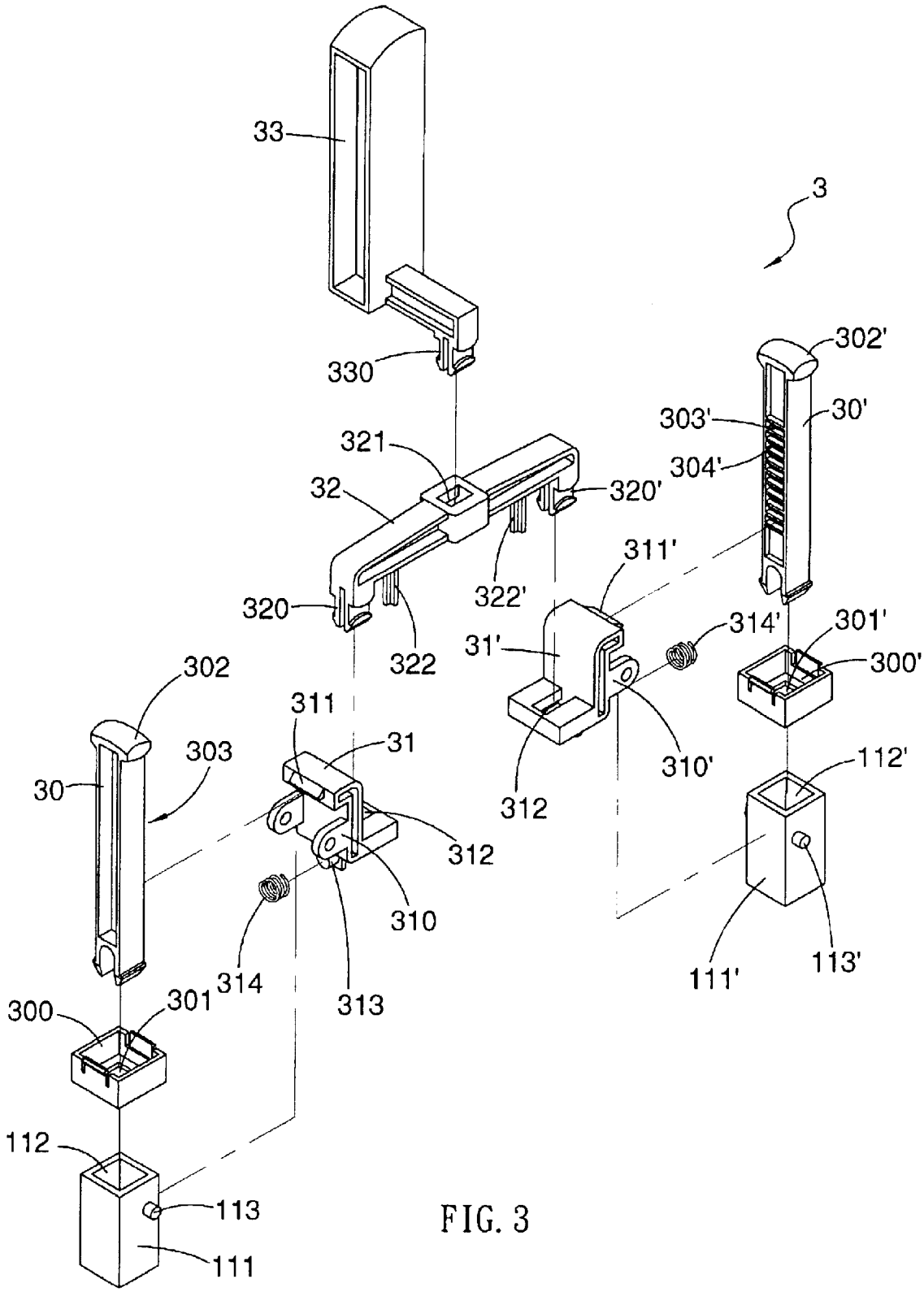
FIG. 3 is an exploded view of the first positioning system of the embodiment.
Figure 4:
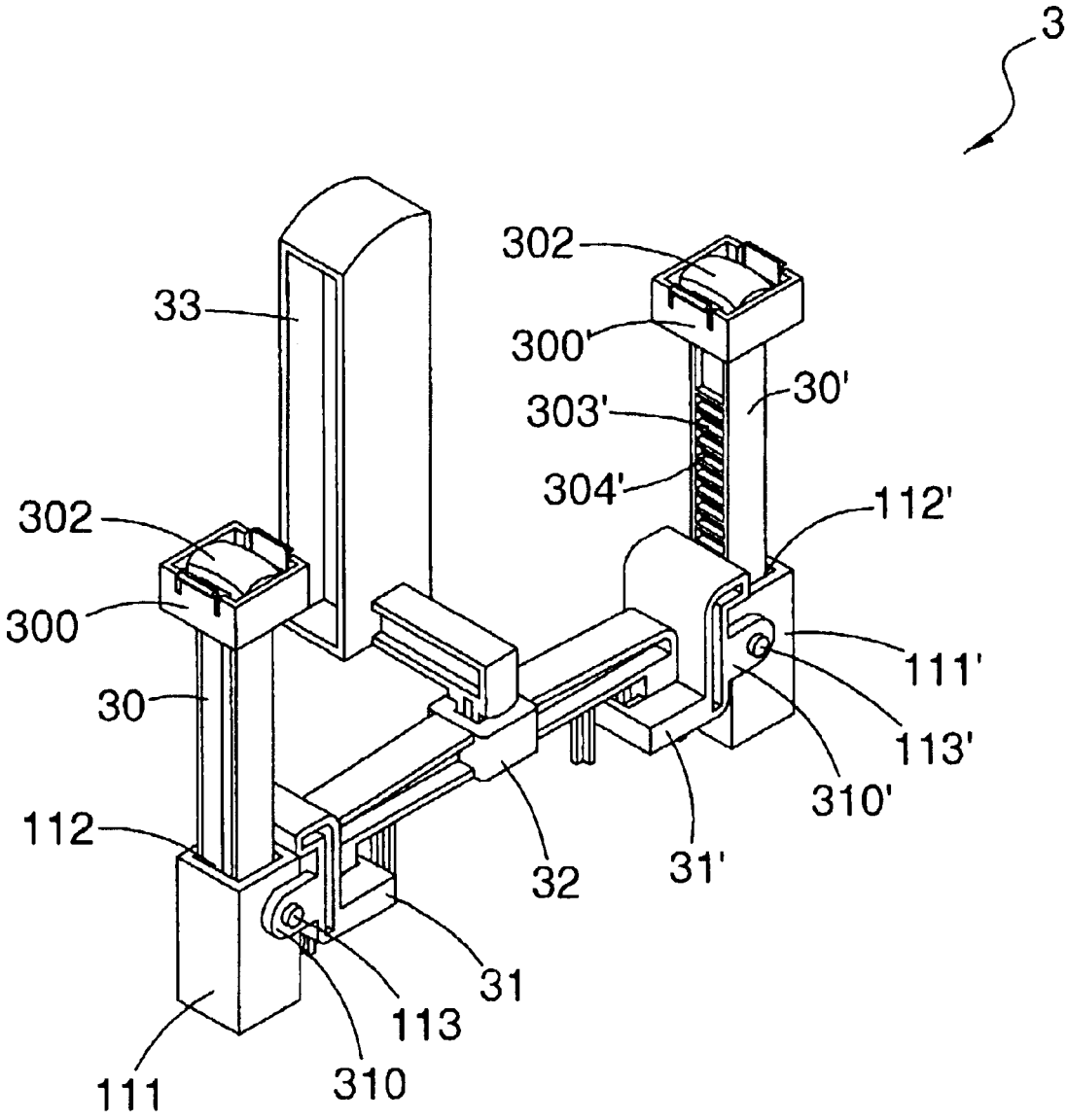
FIG. 4 is an assembled perspective view of the first positioning system of the embodiment.

Referring to FIG. 2, The adjustable golf putting device A mainly contains a base 1, the first ramp plate 2, the second ramp plate 4, The first positioning system 3 and, second positioning system 5 and springs 20, 40. The first positioning system 3 contains means for positioning the first ramp plate 2 and means for releasing the means for positioning the first ramp plate 2. The second positioning system 5 contains means for positioning the second ramp plate 4 and means for releasing the means for positioning the second ramp plate 4. The first ramp plate 2 is pivotally connected with the second ramp plate 4. The pivotal sides of the first ramp plate and the second ramp plate contain several pivots 24, 42. Several pivoting elements 44 pivotally connected the pivots 24, 42 at both sides. Plural recesses 25 are installed at the pivotal side of the first ramp plate. Sliding elements 26 are inserted at the recesses 25. The sliding element 26 can be rotated to the recess 43 at the side of the second ramp plate to smooth where the ramp plates connect. The second ramp plate 4 also has pivots 45 and recess 46 and sliding element 47 for connecting another ramp plate.

Figure 6:
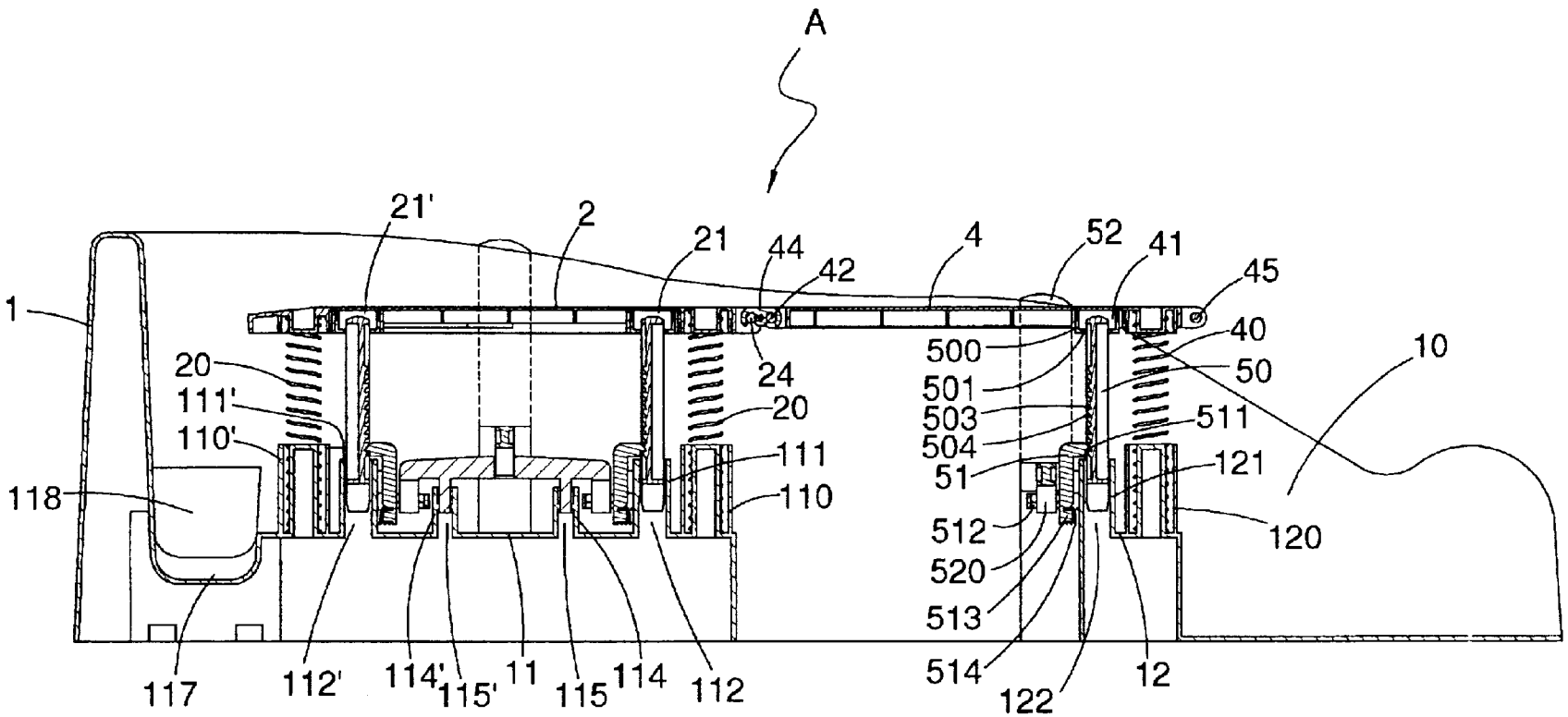
FIG. 6 is a cross sectional view of the embodiment.

With reference to FIG. 2 and FIG. 6, the base 1 constructs a containing space 10. The first platform 11 and the second platform 12 are installed within the space 10. On two sides of the first platform 11, spring holders 110, 110' are installed for holding springs 20. The hollow rods 114, 114' are installed between the spring holders 110, 110' on the base 1.

With reference to FIG. 2, FIG. 3, FIG. 4 and FIG. 6, the means for positioning the first ramp plate 2 contains the seats 111, 111', engaging elements 300, 300', columns 30, 30', the fixing element 31, 31' and the springs 314, 314'. The seat 111, 111' have channels 112, 112' therein and the protrusions 113, 113' on two sides of the seat 111, 111' respectively. The engaging elements 300, 300' have through holes 301, 301' therein. The engaging elements 300,300' are engaged with the plugging holes 21 of the first ramp plate 2. The columns 30, 30' contain plural inward saw teeth 304, 304'therein and heads 302, 302'on their tops. The columns 30, 30' are inserted through the through holes 301, 301' and the heads 302, 302' are bigger than the through hole 301, 301'so the heads 302, 302' will not slid out of the through hole 301, 301'. The fixing elements 31, 31' contain hooks 311, 311' for being hooked with the inward saw teeth 304,304' in the slots 303, 303' formed between the slope surfaces 304, 304'. Two pair of ears 310, 310' have holes therein pivotally adopted to the protrusions 113, 113' respectively. The cylinders 313, 313' are formed on the fixing elements 31,31'. The engaging holes 312, 312' are formed in the fixing elements at the other sides of the cylinders 313, 313'. The springs 314,314' circle the cylinders 313,313' and are against one side of the seat 111, 111'.

The means for releasing the means for positioning the first ramp plate 2 contains a beam 32 having a connecting hole 321 in the middle, two inserting elements 320, 320'at both ends of the beam 32 for inserting into the engaging holes 312,312'of the fixing elements 31, 31', a push button 33 for being engaged with the connecting hole 321; and two guiding rods 322, 322'on the beam 32 between the inserting elements 320, 320'. The guiding rods 322,322' slide along the channels 115, 115' of the hollow rods 114,114'. Thereby the means for releasing the means for positioning the first ramp plate will not shake when a user pushes the push button 33.

Figure 5:
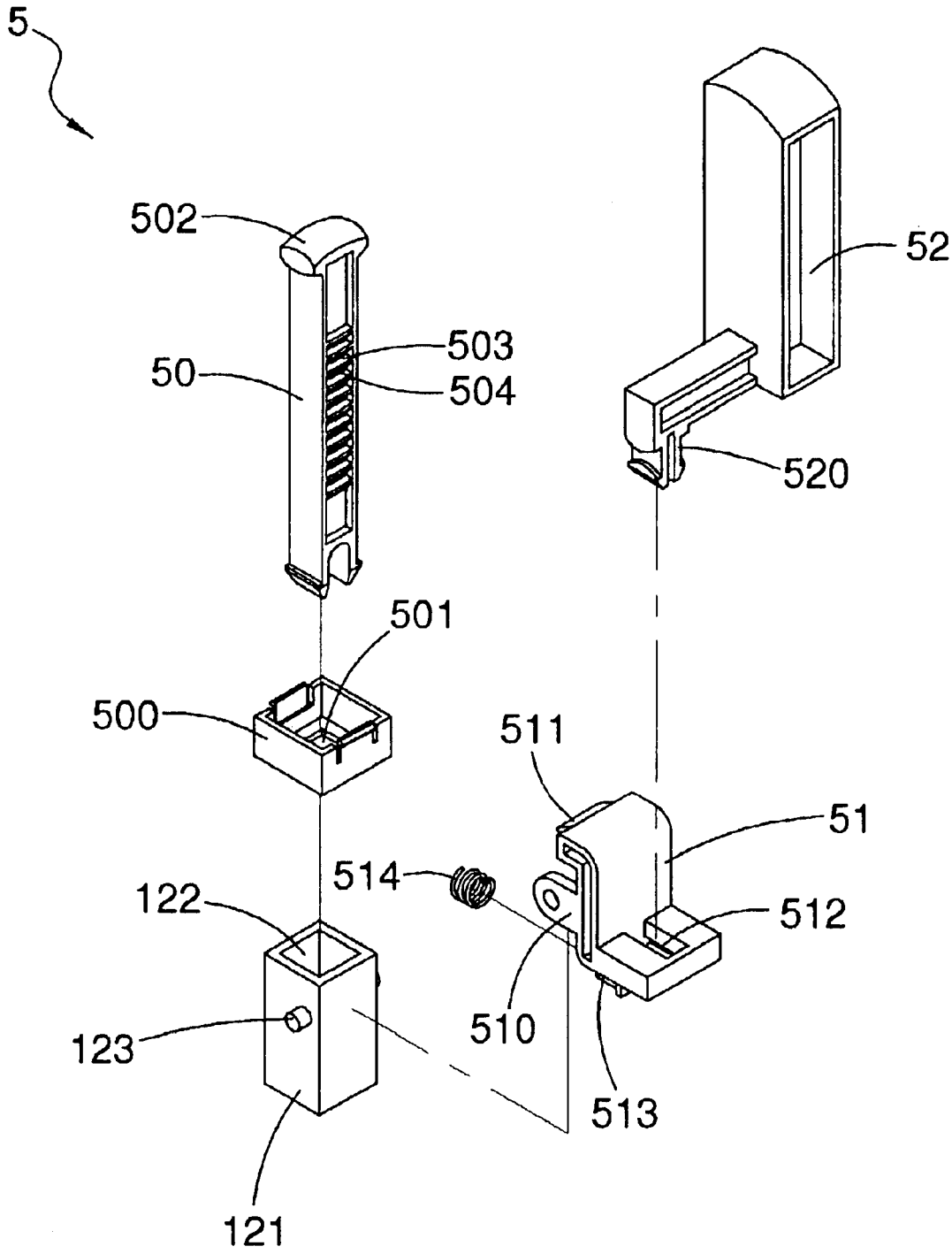
FIG. 5 is an exploded view of the second positioning system of the embodiment.

With reference to FIG. 2, FIG. 5 and FIG. 6, the spring holders 120 are installed on the second platform 12 for holding springs 40. The means for positioning the second ramp plate 4 contains the seats 121, the engaging element 500, the columns 50, the fixing element 51 and the spring 514. The seat 121 has the channel 122 therein and the protrusion 123 on two sides of the seat 121 respectively. The engaging element 500 has through holes 501 therein. The engaging element 500 is engaged with the plugging holes 41 of the second ramp plate 4. The column 50 contains plural inward saw teeth 504 therein and the heads 502 on its top. The columns 50 is inserted through the through holes 501 and the heads 502 is bigger than the through hole 501, 301'so the heads 502 will not slid out of the through hole 501'. The fixing elements 51 contains hooks 511 for being hooked with the inward saw teeth 504 in the slots 503 formed between the slope surfaces 504. The ears 510 have holes therein and can pivotally adopted to the protrusions 123 respectively. The cylinder 513, is formed on the fixing elements 51. The engaging hole 512 is formed in the fixing element 51 at the other side of the cylinders 513. The spring 514 circles the cylinder 513 and is against one side of the seat 121.

The means for releasing the means for positioning the first ramp plate 2 contains a push button 52 and an inserting element 520 connected to the push button 52 for being engaged with the engaging hole 512.

Figure 7:
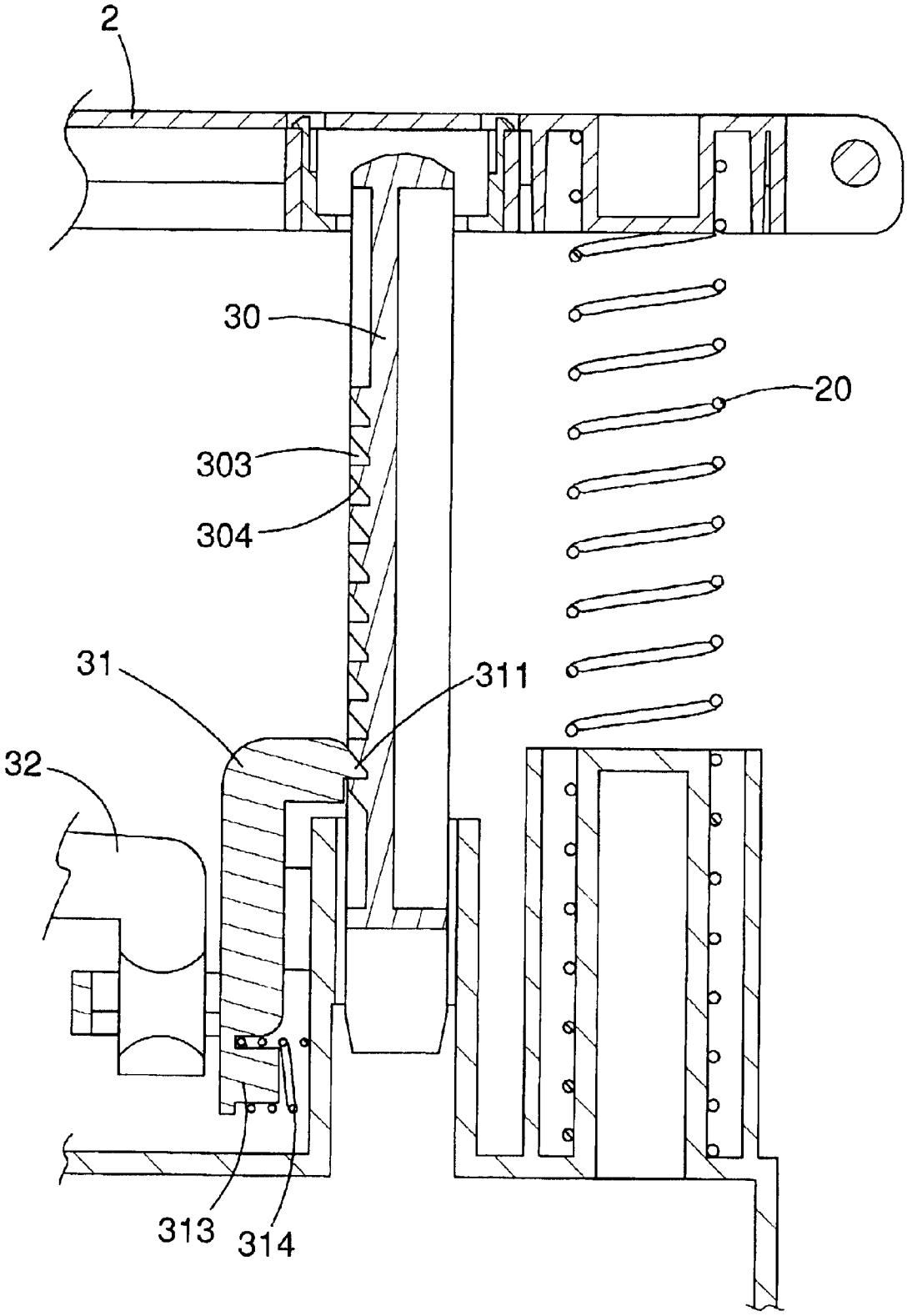
FIG. 7 is a cross sectional view of the embodiment showing the hook engaged with the saw teeth of the column in the original position.
Figure 8:
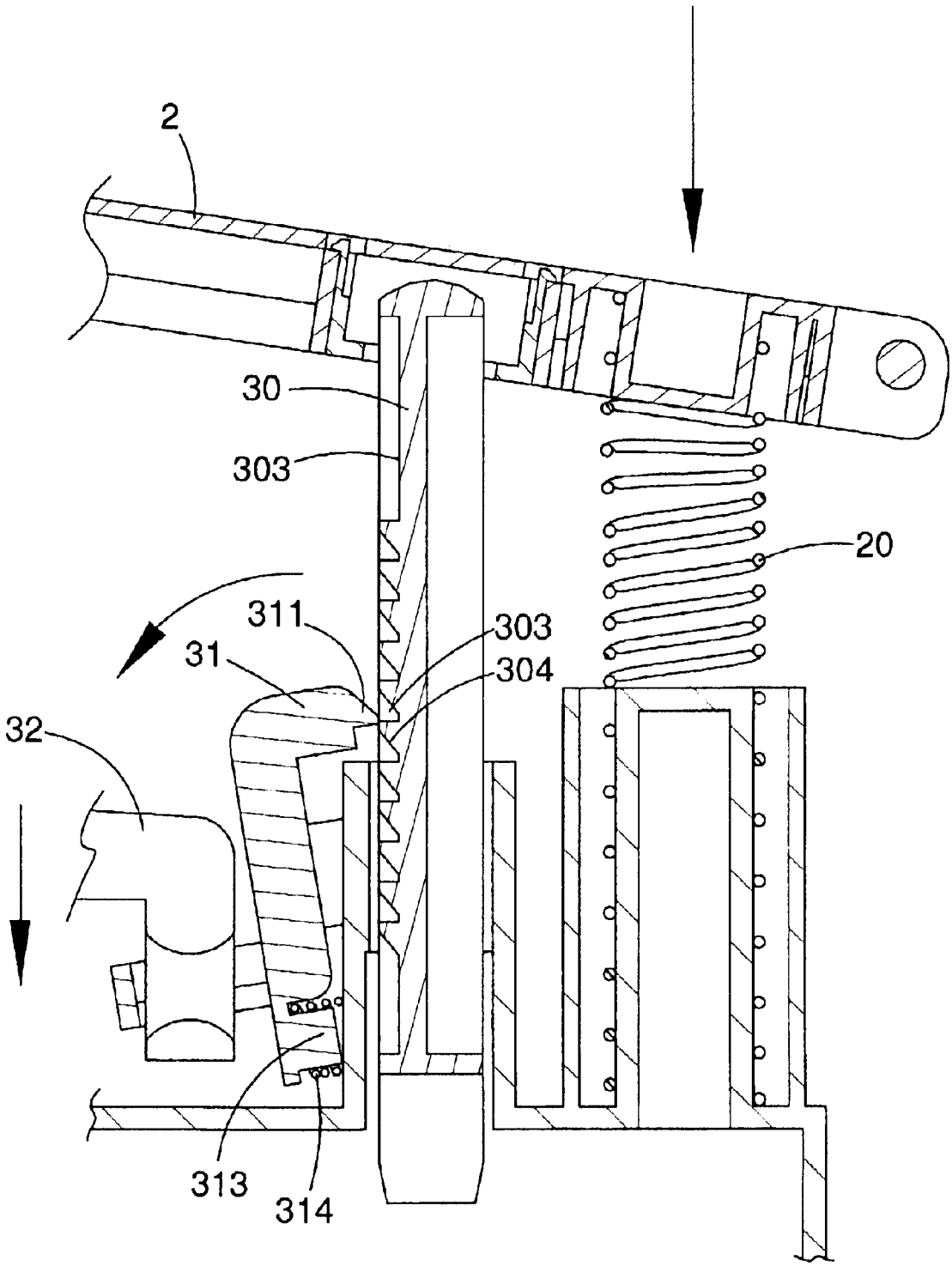
FIG. 8 is a cross sectional view of the embodiment showing when one side of the ramp plate is pressed, the hook is engaged with the saw teeth in a new position.
Figure 9:
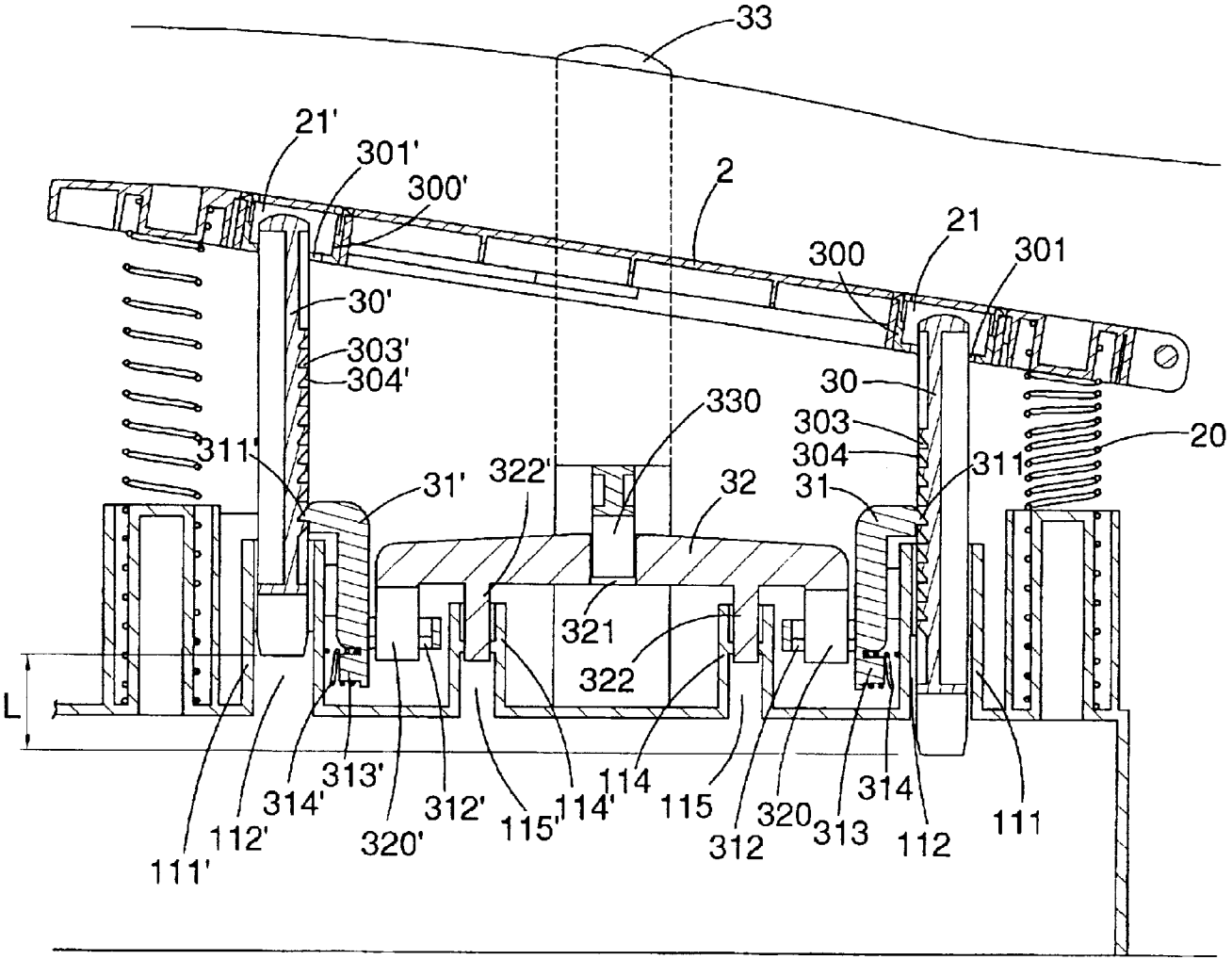
FIG. 9 is a cross sectional view of the embodiment showing the relative positions of the elements of the embodiment when the first ramp plate is pressed forward.

Referring to FIG. 7, there is illustrated that the end 311 of the hook 31 is engaged with the saw teeth 304 of the column in the original position. With reference to FIG. 8 and FIG. 9, when the ramp plate 2 is pushed forward or backward, the corresponding columns 30 will move downward, the hook will be pushed by the saw teeth 304 and lay back a little to let the columns 30 move down and when the push force is removed, the spring 314 will rotate the hook 31 clockwise and the end 311 of the hook 31 will be engaged with the saw teeth 304 of the column 30 by the ejecting force of the springs 20. When the push button 33 is pushed down, the beam 32 will move down and cause the hook to rotate counterclockwise, then the end 311 of the hook 31 is released from the saw teeth 304. The rejecting force of the springs 20 will force the first ramp plate 2 returns to its original position. When the force applied on the button 33 is removed, the spring 314 will cause the hook 31 rotate clockwise and the end 311 of the hook will engage with the saw teeth again. Therefore a user can adjust the height and slope of the first ramp plate to his desired position by pushing the first ramp plate 2. If the user is not satisfied with his adjustment, he can push the push button 33 and let the first ramp plate move upward to his desired position then remove the force.

Figure 10:
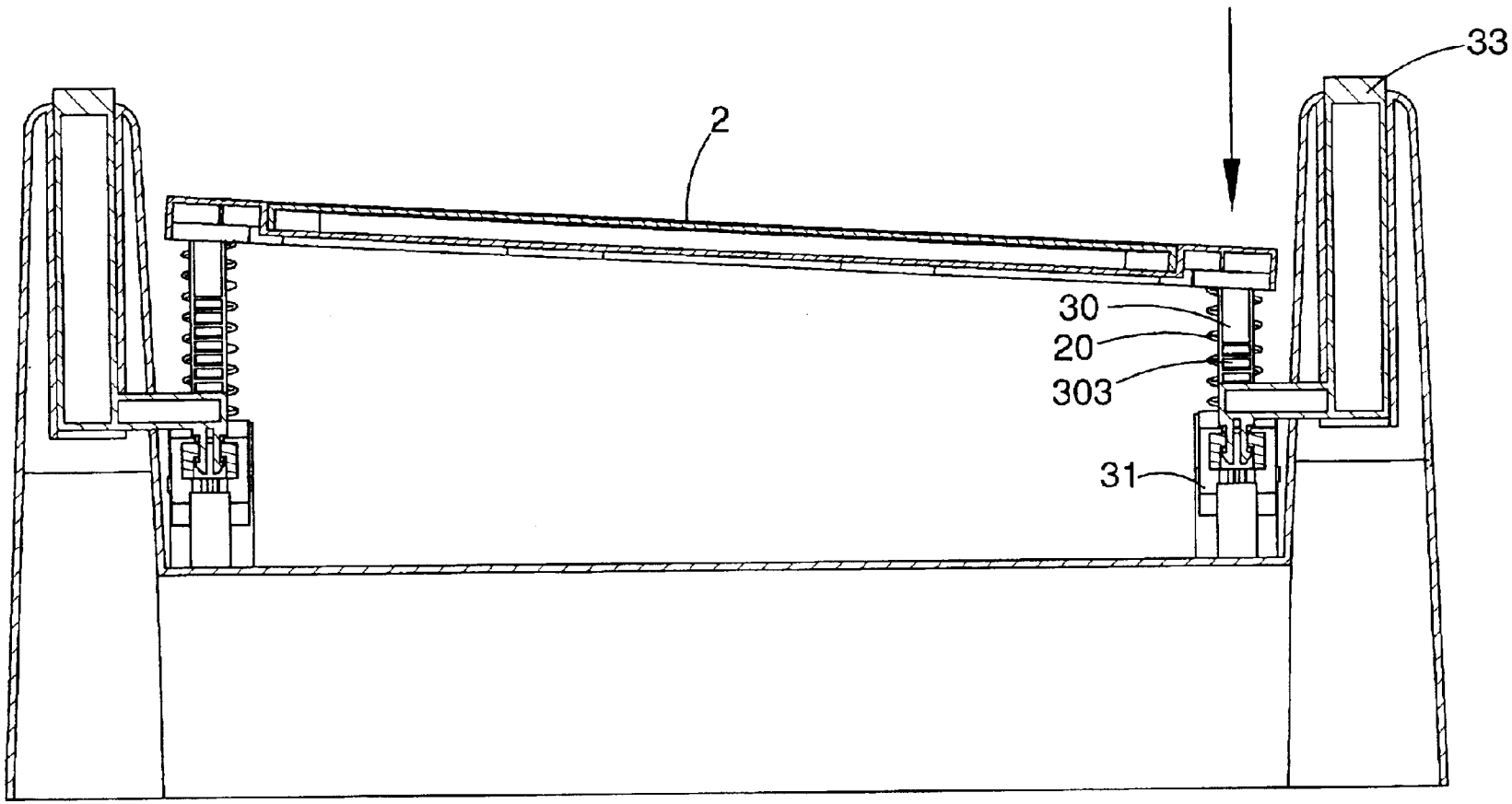
FIG. 10 is a cross sectional view of the embodiment showing the relative positions of the elements of the embodiment when the first ramp plate is pressed sideward.

FIG. 10 illustrates a situation of pushing the first ramp plate sideward. The situation is the same as pushing the first ramp plate backward or forward. The way of adjusting the second ramp plate 4 is similar to the way of adjusting the first ramp plate.

Figure 11:
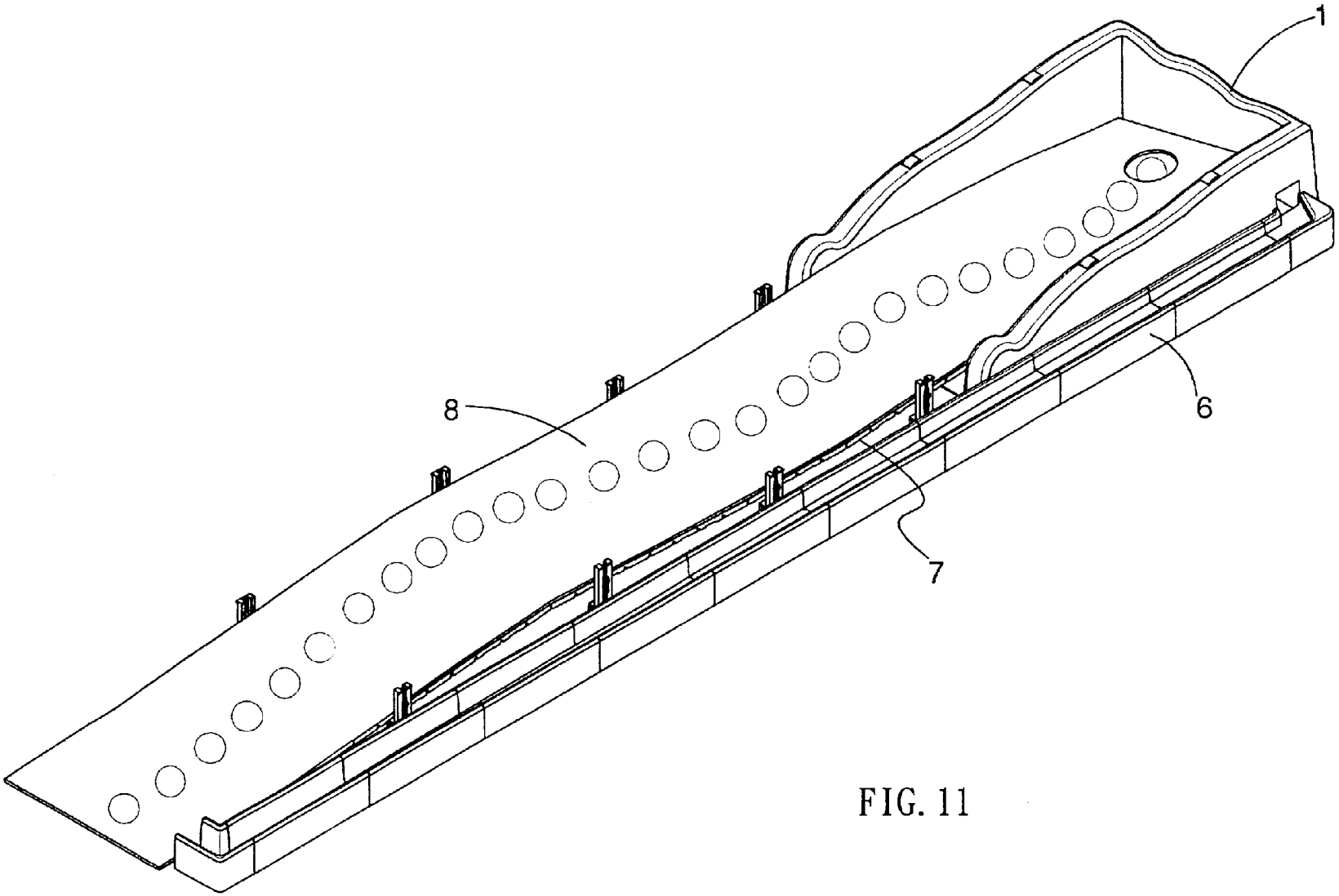
FIG. 11 is a perspective view of another embodiment.

With reference to FIG. 11, another embodiment of the invention is the first embodiment incorporated with the ramp plates 7, ball return gutter 6 and artificial grass carpet 8 as illustrated in FIG. 1.

Figure 12:
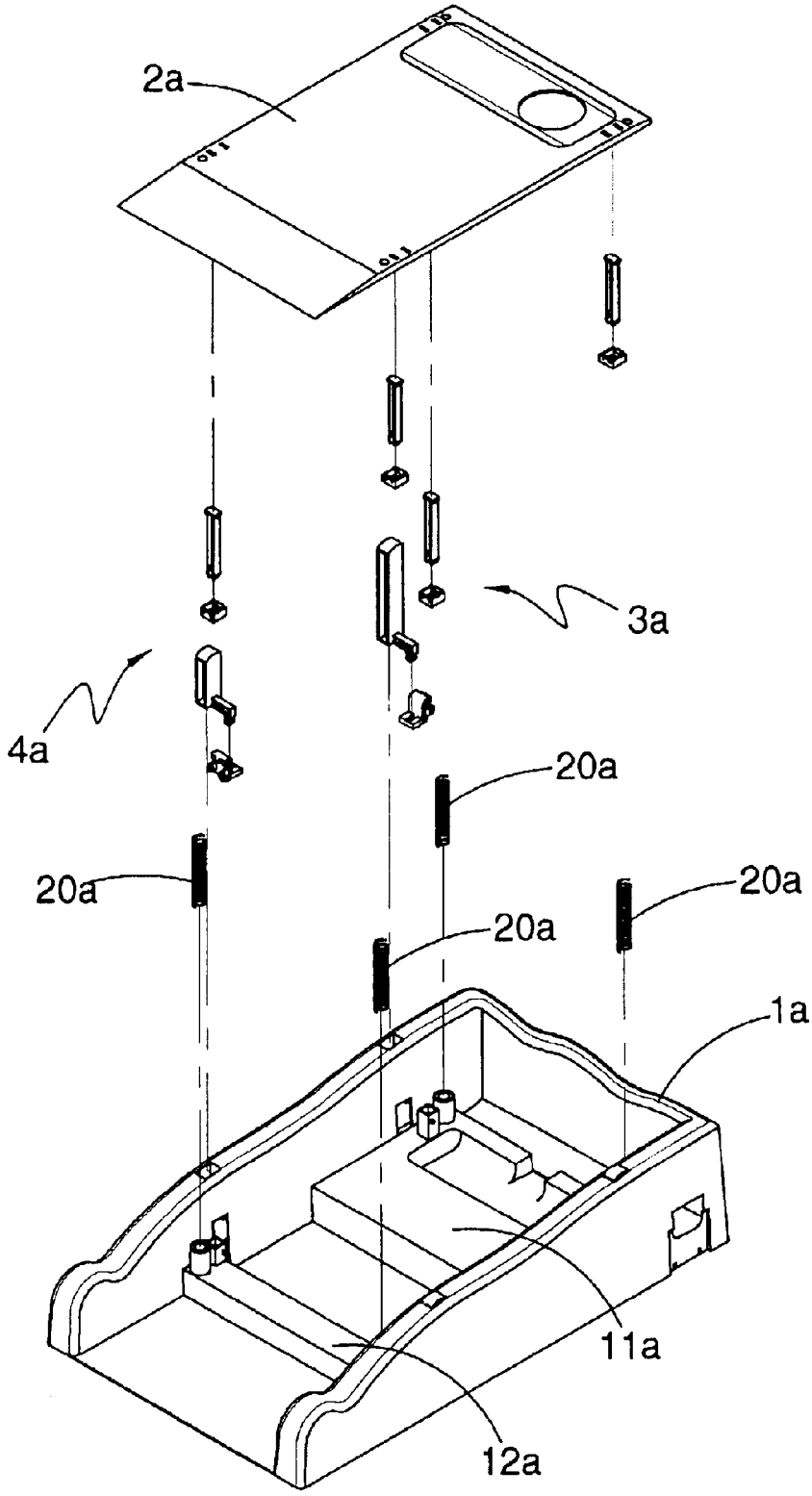
FIG. 12 is an exploded view of a further embodiment.

Further embodiment is illustrated in FIG. 12. The embodiment has the base 1*a*. The first platform 11*a* and the second platform 12*a* are installed inside the base 1*a*. Several springs 20*a* located on the platforms 11*a*, 12*a* are used to support the ramp plate 2*a*. Two positioning system 3*a*, 4*a* as described in the first position system in the first embodiment is located at two sides of the base 1*a* respectively.

Figure 13:
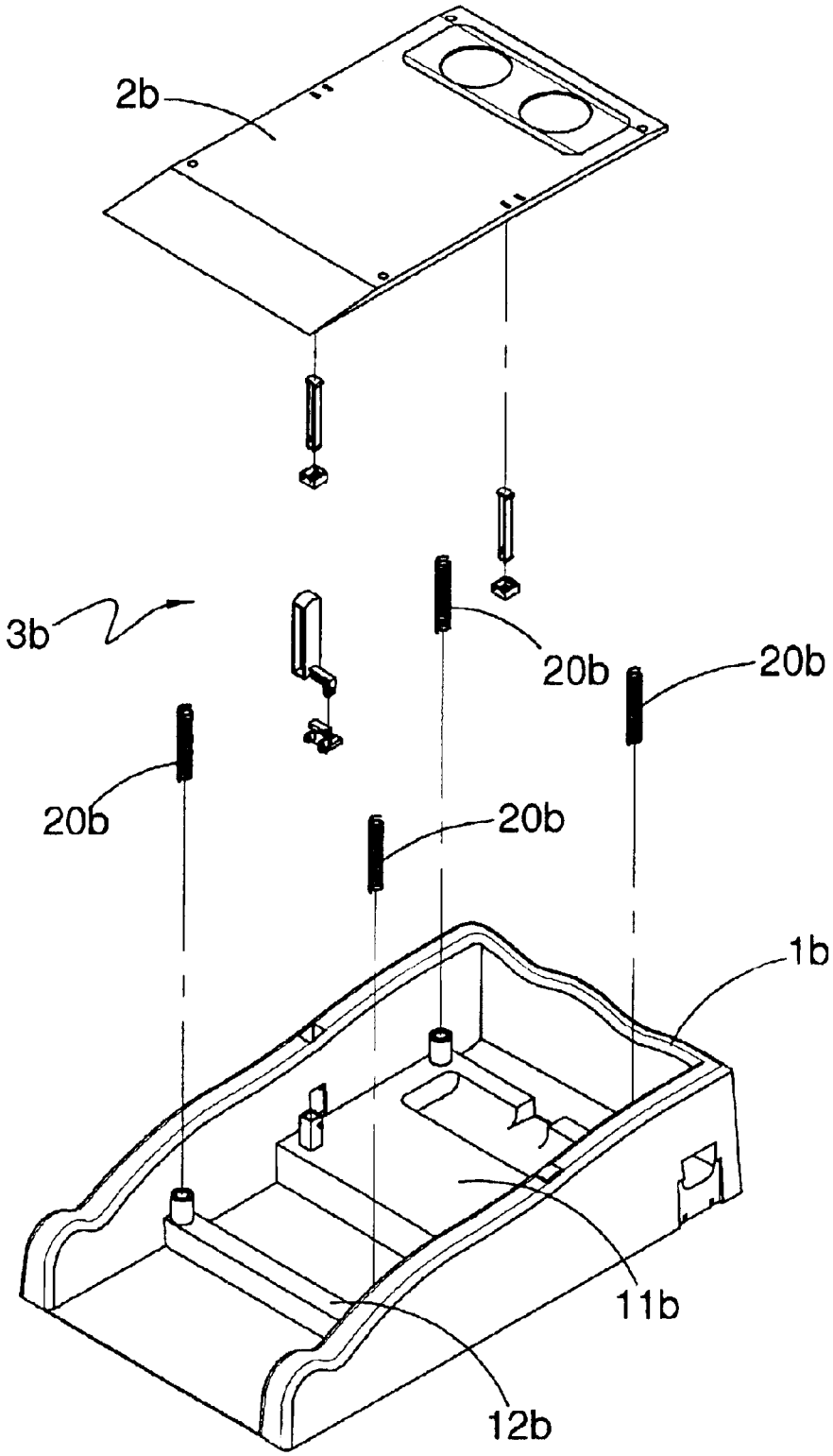
FIG. 13 is an exploded view of still another embodiment.
Figure 14:
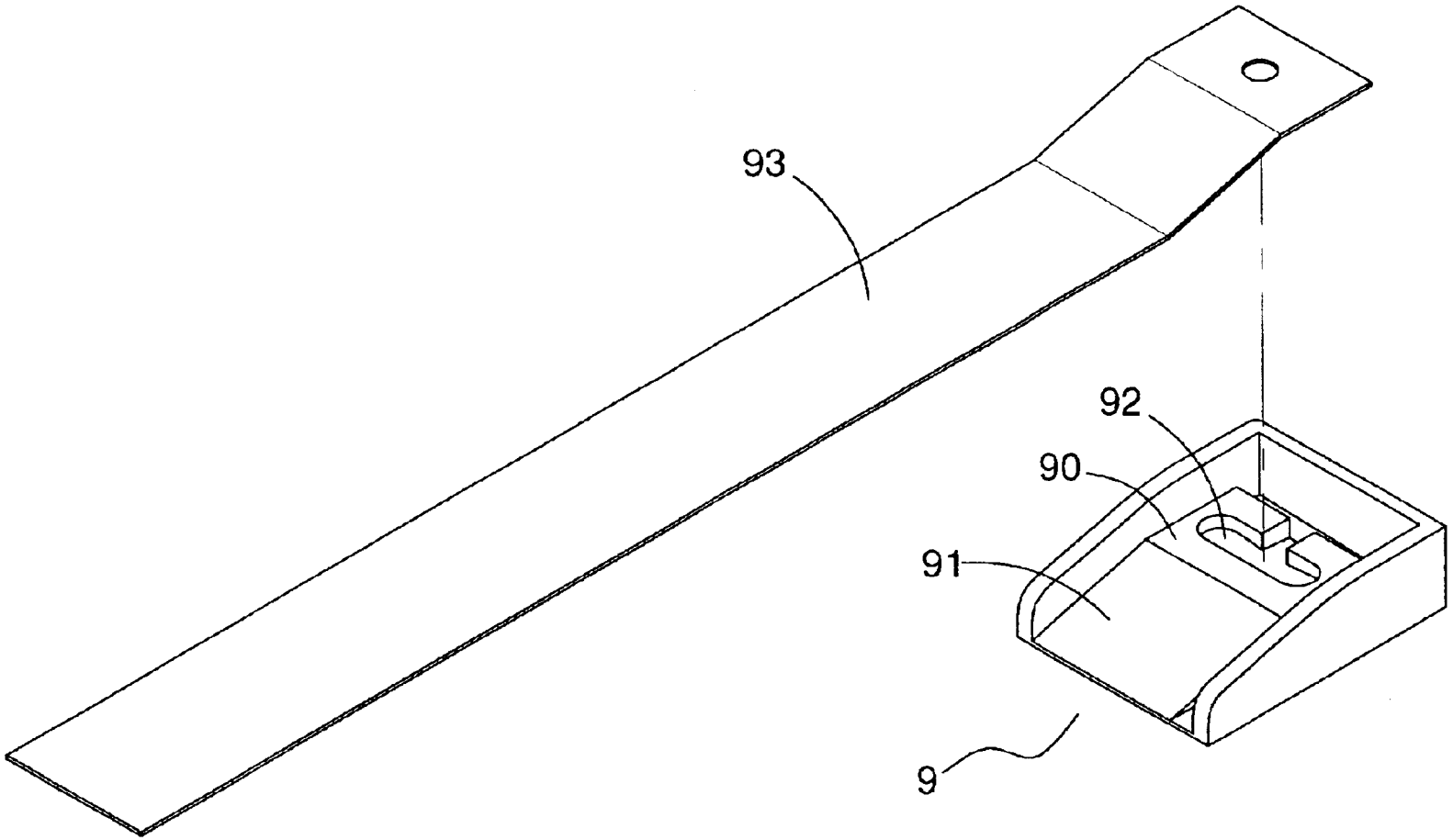
FIG. 14 (PRIOR ART)
FIG. 14 is a perspective view of a traditional golf putting practice device.

Still another embodiment is illustrated in FIG. 13. The embodiment has the base 1*b*. The first platform 11*b* and the second platform 12*b* are installed inside the base 1*a*. Several springs 20*b* located on the platforms 11*b* 12*b* are used to support the ramp plate 2*b*. Two positioning system 3*b*, 4*b* as described in the second position system in the first embodiment is located at two sides of the base 1*a* respectively.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extend indicated by the broad general meaning of the terms in which the appended claims are expressed.

I claim:

1. An adjustable golf putting practice device comprising:

a base comprising a ball return gutter;

a plurality of springs installed in said base;

at least one ramp plate supported by said springs, said ramp plate having a hole therein disposed in correspondence with said ball return gutter;

means for positioning said at least one ramp plate in a desired height and slope, said means for positioning said ramp plate including:

(a). a seat having a channel therein and two protrusions on its two sides;

(b). an engaging element having a through hole therein, said engaging element being engaged with said ramp plate;

(c). a column having a head at one end thereof being inserted through said through hole, said head being bigger than said through hole, said column having a plurality of inward saw teeth formed thereon;

(d). a fixing element, said fixing element including:

(i). a hook for being hooked with said inward saw teeth;

(ii). two ears having holes therein for respective pivotal coupling to said protrusions;

(iii) a cylinder thereon; and, (iv) an engaging hole formed in an opposing side of said cylinder; and, (e). a spring circling said cylinder, said spring being disposed against one side of the seat; and means for releasing said means for positioning said ramp plate.

2. An adjustable golf putting practice device comprising:

a base having a ball return gutter;

a plurality of springs installed in said base;

a first ramp plate supported by said springs, said first ramp plate having a hole therein disposed in correspondence with said ball return gutter, said first ramp plate having a frame therein, said first ramp plate including an engaging plate having said hole therein, said engaging plate being engaged with said frame;

a second ramp plate pivotally connected with said first ramp plate;

means for positioning said first and second ramp plates in a desired height and slope; and means for releasing said means for positioning said ramp plate.

3. The adjustable golf putting practice device of claim 1 wherein said ramp plate comprises plugging holes for being engaged with said engaging element.

4. The adjustable golf putting practice device of claim 1 wherein said means for releasing said means for positioning said ramp plate comprises;

a beam having a connecting hole in the middle;

two inserting elements at both ends of said beam for inserting into said engaging hole of said fixing element;

a push button for being engaged with said connecting hole; and two guiding rods on said beam between said inserting elements.

5. The adjustable golf putting practice device of claim 1 wherein said means for releasing said means for positioning said ramp plate comprises:

a push button;

an inserting element connected to said push button for being engaged with said engaging hole.

6. The adjustable golf putting practice device of claim 4 further comprising plural hollow rods on said base, wherein said guiding rods respectively slide within said hollow rods.

* * * * *